US006209843B1

(12) United States Patent
Smith, Jr.

(10) Patent No.: US 6,209,843 B1
(45) Date of Patent: Apr. 3, 2001

(54) PIVOTAL ROCKING CHAIR BASE

(76) Inventor: R. Brantley Smith, Jr., 3551 Lassiter Mill Rd., Asheboro, NC (US) 27203

( * ) Notice: Subject to any disclaimer, the term of this patent is extended or adjusted under 35 U.S.C. 154(b) by 0 days.

(21) Appl. No.: 09/333,148

(22) Filed: Jun. 14, 1999

(51) Int. Cl.[7] ..... F16M 13/00; A47C 3/03

(52) U.S. Cl. ..... 248/561; 248/346.01; 248/582; 297/268.1; 297/270.1

(58) Field of Search ..... 248/561, 563, 248/573, 574, 578, 349.1, 346.01, 618, 624, 371, 372.1, 394, 396; 297/268.1, 270.1

(56) References Cited

U.S. PATENT DOCUMENTS 2,729,273 * 1/1956 Hamilton et al. ..... 248/576
3,603,553 * 9/1971 Doerner ..... 248/578
3,784,148 * 1/1974 Hill ..... 248/582
4,025,020 * 5/1977 Goff et al. ..... 248/582
4,438,973 * 3/1984 LaPointe ..... 297/344.25
4,705,256 * 11/1987 Hofrichter ..... 248/418
4,736,984 * 4/1988 Tacker ..... 297/268.1
4,893,871 * 1/1990 Kowalski ..... 297/270.1
5,435,622 * 7/1995 Fay et al. ..... 297/259.2
5,567,009 * 10/1996 Fay et al. ..... 297/258.1

* cited by examiner

*Primary Examiner*—Anita M. King

(57) ABSTRACT

A pivotal rocking chair base is provided which allows the ultimate chair user to select or eliminate the rotational movement of the chair base. Also, by making adjustments to front and rear turnbuckles the amount or degree of tilt or rocking action of the seat can be chosen. An infinite variety of adjustments is thus available to the user to customize the chair motion for his particular purposes and comfort.

13 Claims, 3 Drawing Sheets

PIVOTAL ROCKING CHAIR BASE

BACKGROUND OF THE INVENTION

1. Field of the Invention

The invention herein pertains to a chair base and particularly to a chair base which provides both pivotal and rocking action.

2. Description of the Prior Art and Objectives of the Invention

It is usual in the furniture industry to provide a chair base which will allow the chair to rotate horizontally and to rock or tilt. Such chair bases have been produced for many years as illustrated in U.S. Pat. No. 4,025,020. These chair bases include coil or other springs to allow rocking while a center axis defines the rotational motion. Such chair bases are in widespread use by furniture manufacturers. Oftentimes a commercial customer will require the manufacturer to rigidly affix the rocker assembly or horizontal swivel mechanism to prevent either the rocking or rotational movement and sometimes both. This has generally been carried out in the past by welding braces or supports to rigidly affix the chair base. While such measures do serve the intended purposes, consumers often demand a more versatile chair, namely one that they can adjust and change as desired rather than one which has been permanently modified. Thus a chair owner may wish to cease all horizontal rotational movement, yet enjoy the rocking motion. Another chair owner may desire to set a particular tilt to the chair but allow the rotational movement to be free and unencumbered.

Thus for the more demanding consumer the present invention was conceived and one of its objectives is to provide a pivotal rocking chair base which can be easily, manually adjusted and its motion selectively limited.

It is still another objective of the present invention to provide a chair base in which the horizontal rotational movement can be stopped while allowing the tilting or rocking motion to continue unabated.

It is yet another objective of the present invention to provide a chair base which will allow the user to selectively terminate the rocking motion yet allowing the rotational movement to continue.

It is still a further objective of the present invention to provide chair base which can be quickly and easily transformed from one of free movement to one of very limited movement manually by a consumer.

It is yet another objective of the present invention to provide a chair base which is relatively inexpensive to purchase and which can be manufactured at relatively low cost.

Various other objectives and advantages of the present invention will become apparent to those skilled in the art as a more detailed description is provided below.

SUMMARY OF THE INVENTION

The aforesaid and other objectives are realized by providing a pivotal rocking chair base for attachment to an upholstered or other chair. The chair base includes a rocker assembly having a rocker plate and a resiliently mounted base plate. The rocker assembly is pivotally attached by a central axle to a swivel plate from which legs depend. The swivel plate includes a threaded stop member which can be aligned with an aperture in the base plate of the rocker assembly. Thus by manually turning the stop member it will extend into the base plate aperture and prevent horizontal-rotational or pivotal movement of the rocker assembly. Front and rear turnbuckles affixed such as by welding or the like along the front and rear edges of the base plate allow the user to manually adjust the amount of tilt or rocking action which occurs between the base plate. The front or first turnbuckle acts as an adjustable assembly to define the minimum space between the front of the rocker plate and the front of the base plate. A second adjustable assembly or turnbuckle is rigidly affixed proximate the rear edge of the base plate which is likewise manually adjustable and can be extended or shortened, depending on the particular tilt or angle desired for the chair seat. By extending both adjustable assemblies fully, tilting and rocking action is therefore prevented.

DETAILED DESCRIPTION OF THE PREFERRED EMBODIMENT AND OPERATION OF THE INVENTION

Figure 1:
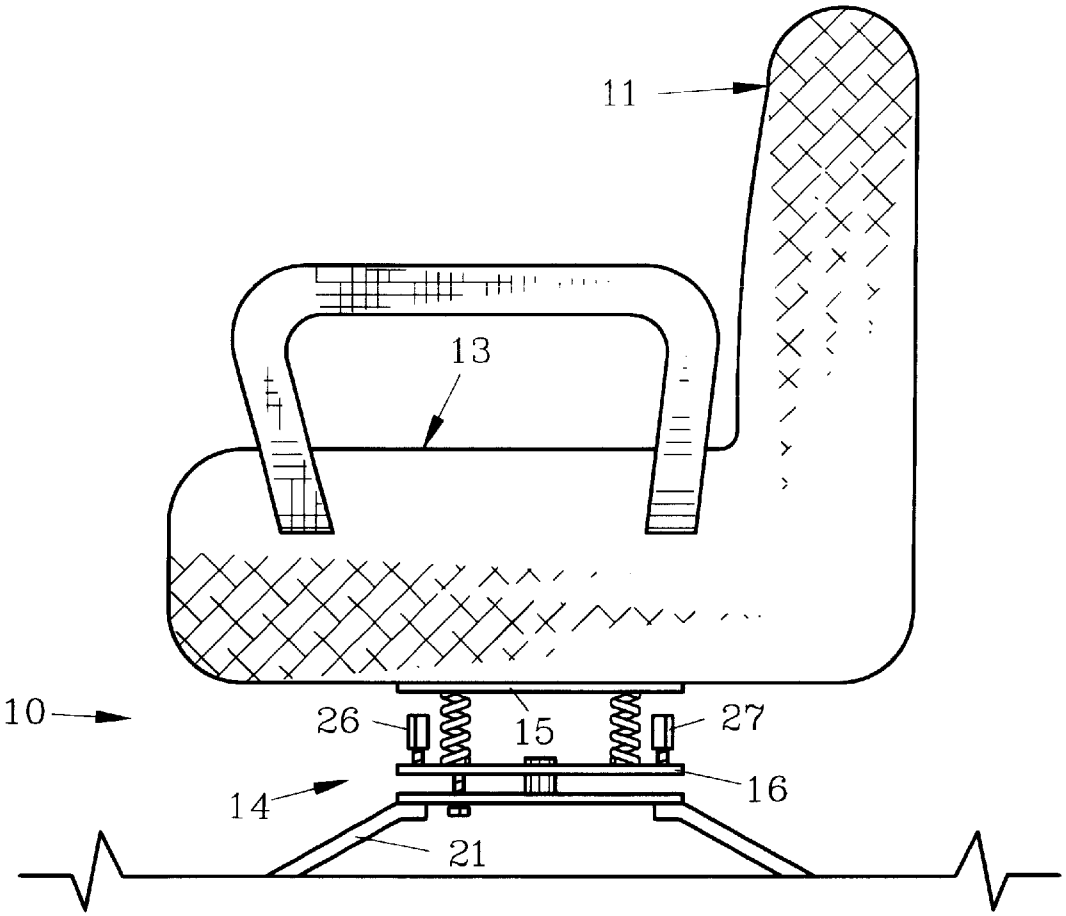
FIG. 1 depicts a typical chair with the preferred pivotal rocking chair base attached.
Figure 2:
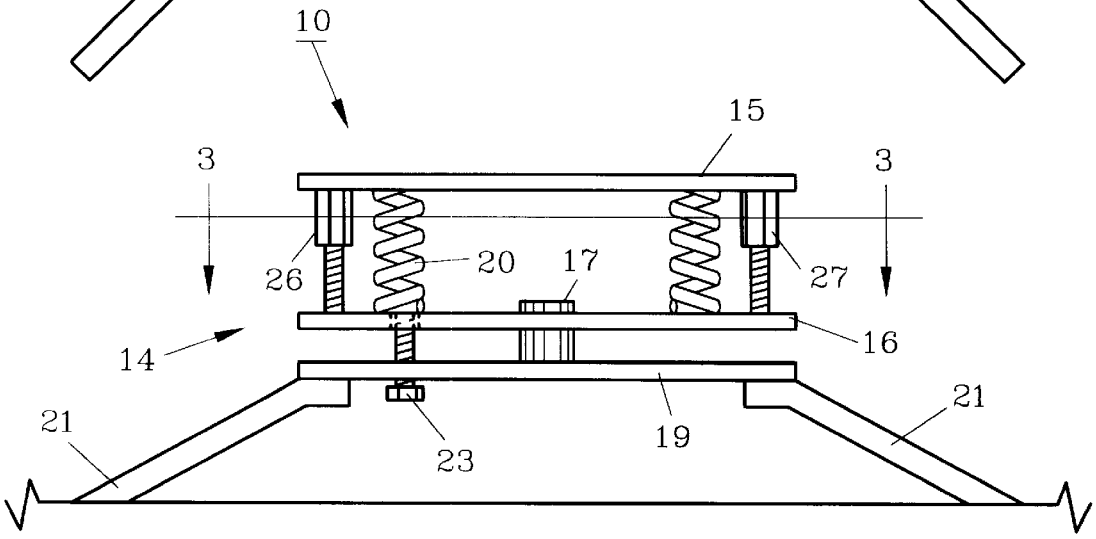
FIG. 2 illustrates an enlarged side elevational view of the pivotal rocking chair b Pas shown in FIG. 1.

For a better understanding of the invention, turning now to the drawings, FIG. 1 demonstrates the preferred form of pivotal rocking chair base 10 attached to the bottom of seat 13 of a conventional upholstered chair 11 such as usual by bolts, screws or otherwise. As hereinbefore explained, pivotal chair bases which rock and pivot are old and are well known in the industry. However, purchasers of such chairs often desire to temporarily limit or eliminate the rocking motion as between rocker plate 15 and base plate 16 of rocker assembly 14 as shown in FIGS. 1 and 2. Also, it is not unusual for purchasers or users of chair 11 to want to prevent the horizontal rotation of such chairs in an easy, convenient but temporary manner.

Figure 3:
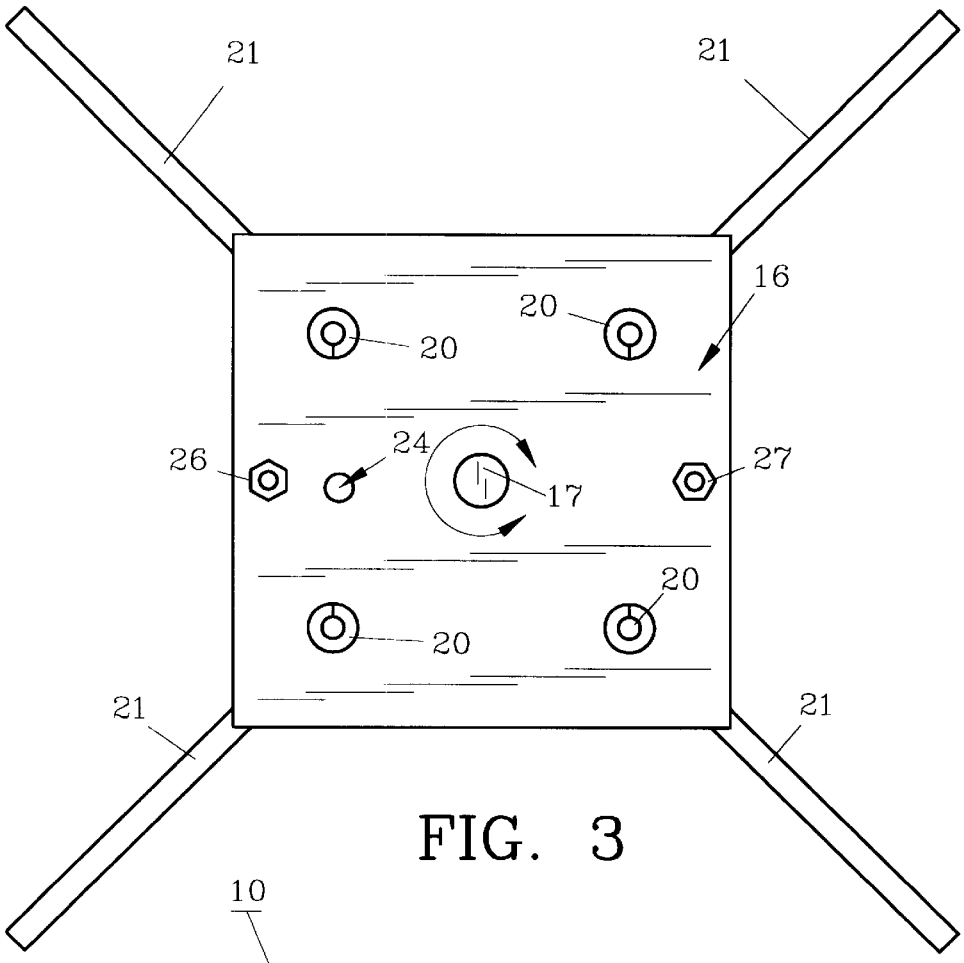
FIG. 3 demonstrates a plan view along lines 3—3 of FIG. 2.

As seen, rocker assembly 14 is pivotally attached by axle 17 to swivel plate 19 for rotational movement. Rocker plate 15 is resiliently attached to base plate 16 by resilient coil springs 20 as seen in FIGS. 2 and 3 for rocking or tilting action. Legs 21 affixed to swivel plate 19 are formed from tubular steel or other suitable materials and are affixed such as by bolting, welding or the like. As conventional, rocker assembly 14 will rotate about axle 17 and will tilt according to the particular load distribution on seat 13 as seen in FIG. 1 as resilient coil springs 20 expand, relax or contract depending on the particular load applied.

It is often desirable to terminate the horizontal rotational movement between rocker assembly 14 and swivel plate 19 and accordingly, preferred stop member 23 will accommodate this. Stop member 23 is threadably affixed to swivel plate 19 and when desired, the user of chair 11 can simply rotate stop member 23 and extend it upwardly, into aligned aperture 24 of base plate 16 as shown in FIG. 3. Thus stop member 23 effectively, rigidly affixes rocker assembly 14 to swivel plate 19 when rotation is not desired. Thereafter, if rotation is again needed, stop member 23 can be manually rotated in the opposite direction, withdrawing it from aperture 24 of base plate 16 to allow rocker assembly 14 to again rotate horizontally about axle 17 as shown in FIGS. 2 and 3.

Figure 4:
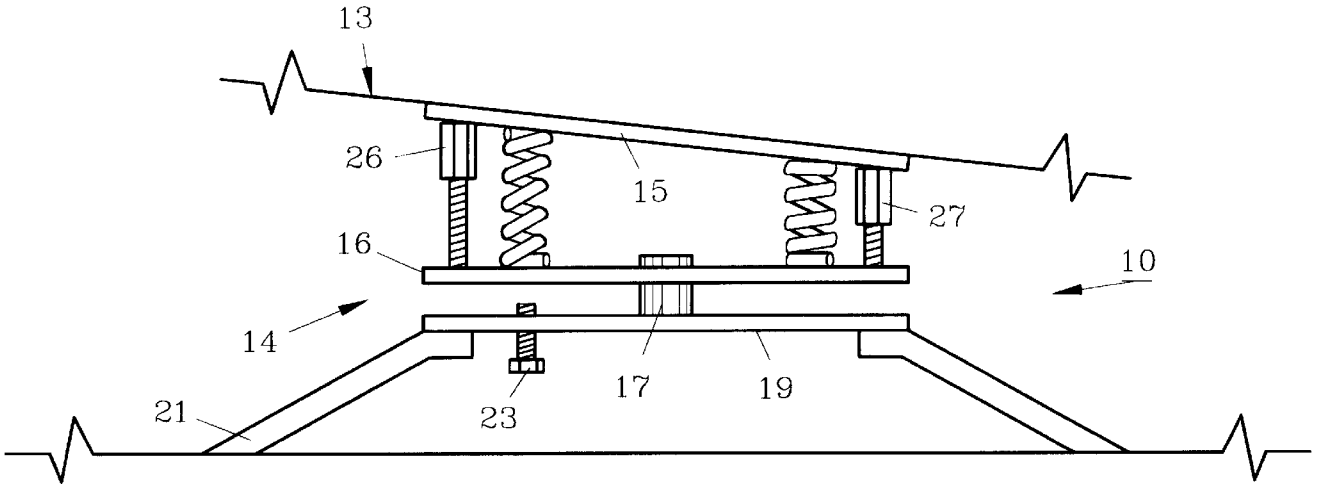
FIG. 4 shows the chair base as seen in FIG. 2 but with the adjustable assemblies configured for a seat rear tilt.
Figure 5:
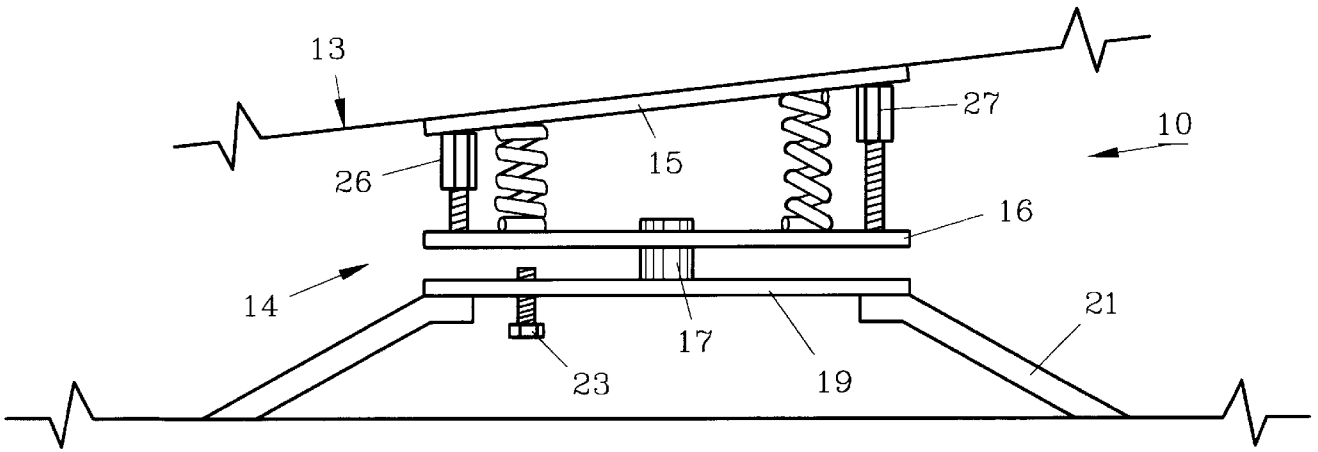
FIG. 5 features the chair base as shown in FIG. 4 but with the adjustable assemblies configured to provide the seat with a forward tilt.

As further shown in FIG. 1, chair 11 can rock or be tilted by the load distribution on chair seat 13 as coil springs 20 expand and contract according to the weight distribution. Should it be desirable to prevent the rocking action or to affix the tilt in any of a infinite variety of positions such as the rearward tilt as shown in FIG. 4 or in a forward tilt as shown in FIG. 5, standard adjustable threaded turnbuckles 26, 27 which are rigidly affixed to the front and rear edges of base plate 16 can be selectively rotated to apply greater, lesser or zero pressure on rocker plate 15. Thus, if a rearward tilt of chair seat 13 is desired, front turnbuckle 26 is extended as conventional while rear turnbuckle 27 is reduced in length. Should the opposite tilt of chair seat 13 be desired such as shown in FIG. 5, then front turnbuckle 26 is shortened while rear turnbuckle 27 is lengthened to provide the desired tilt. With turnbuckles 26 and 27 extended as shown in FIGS. 4 and 5, chair 11 will not rock but will remain in a tilted position until turnbuckles 26, 27 are shortened by appropriate manual rotational movement to positions such as shown in FIG. 1 which illustrates both turnbuckles 26, 27 lowered to allow seat 13 to rock and/or tilt freely.

Thus, pivotal rocking base 10 can be manually adjusted as desired either for pivotal or tilting action independently as desired, quickly and easily by the ultimate chair user without the need of expensive tools or equipment.

The illustrations and examples provided herein are for explanatory purposes and are not intended to limit the scope of the appended claims.

I claim:

1. In a pivotal rocking chair base having a rocker assembly and a swivel plate connected thereto, the improvement comprising: a stop member, said rocker assembly defining an aperture therein, said stop member affixed to said swivel plate for selectively engaging said rocker assembly aperture for termination of pivotable movement between said rocker assembly and said swivel plate.

2. A pivotal rocking chair base as claimed in claim 1 wherein said stop member is threaded.

3. A pivotal rocking chair base as claimed in claim 1 wherein said rocker assembly further comprises a base plate, said base plate defining an aperture for reception of said stop member.

4. In a pivotal rocking chair base having a rocker assembly and a swivel plate joined thereto, said rocker assembly comprising a rocker plate and a resiliently mounted base plate, the improvement comprising: a stop member, said stop member affixed to said swivel plate, said swivel base defining an aperture for reception of said stop member, a first adjustable assembly, said first adjustable assembly affixed to said base plate for selectively extending towards said rocker plate to limit the resilient movement between said rocker plate and said base plate.

5. The pivotal rocking chair base as claimed in claim 4 wherein said first adjustable assembly comprises a turnbuckle.

6. The pivotal rocking chair base as claimed in claim 4 further comprising a second adjustable assembly, said second adjustable assembly affixed to said base plate.

7. The pivotal rocking chair base as claimed in claim 6 wherein said first adjustable assembly is positioned at one end of said base plate and said second adjustable assembly is positioned at the opposite end of said base plate.

8. The pivotal rocking chair base as claimed in claim 6 wherein said second adjustable assembly comprises a turnbuckle.

9. In a pivotal rocking chair base having a rocker assembly joined to a swivel plate, said rocker assembly comprising a rocker plate and a resiliently mounted base plate, the improvement comprising: a stop member, said base plate defining an aperture therein, said stop member affixed to said swivel plate for selectively engaging said base plate aperture to terminate pivotal movement between said rocker assembly and said swivel plate, a first adjustable assembly, said first adjustable assembly affixed to said base plate for selectively extending towards said rocker plate to limit the resilient movement between said rocker plate and said base plate.

10. The pivotal rocking chair base as claimed in claim 9 further comprising a second adjustable assembly, said second adjustable assembly affixed to said base plate for selectively extending towards said rocker plate to limit the resilient movement between said base plate and said rocker plate.

11. The pivotal rocking chair base as claimed in claim 10 wherein said first adjustable assembly and said second adjustable assembly are mounted on opposite ends of said base plate.

12. The pivotal rocking chair base as claimed in claim 9 wherein said first adjustable assembly comprises a turnbuckle.

13. The pivotal rocking chair base as claimed in claim 9 wherein said stop member is threaded.

* * * * *